US007325605B2

(12) United States Patent
Fripp et al.

(10) Patent No.: US 7,325,605 B2
(45) Date of Patent: Feb. 5, 2008

(54) FLEXIBLE PIEZOELECTRIC FOR DOWNHOLE SENSING, ACTUATION AND HEALTH MONITORING

(75) Inventors: Michael L. Fripp, Carrollton, TX (US); John P. Rodgers, Trophy Club, TX (US); Roger L. Schultz, Aubrey, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/746,281

(22) Filed: May 9, 2007

(65) Prior Publication Data

US 2007/0206440 A1 Sep. 6, 2007

Related U.S. Application Data

(62) Division of application No. 10/409,515, filed on Apr. 8, 2003, now Pat. No. 7,234,519.

(51) Int. Cl.
*E21B 47/00* (2006.01)

(52) U.S. Cl. ..... 166/250.01; 340/854.3; 340/854.4

(58) Field of Classification Search ..... 166/250.01, 166/77.1, 77.2; 367/81–83; 340/854.3, 340/854.5, 854.4; 175/40
See application file for complete search history.

(56) References Cited

U.S. PATENT DOCUMENTS

| | | | | |
|---|---|---|---|---|
| 4,003,252 | A * | 1/1977 | Dewath | 73/861.27 |
| 4,527,425 | A * | 7/1985 | Stockton | 73/152.21 |
| 5,914,911 | A * | 6/1999 | Babour et al. | 367/82 |
| 5,924,499 | A * | 7/1999 | Birchak et al. | 175/40 |
| 6,004,639 | A * | 12/1999 | Quigley et al. | 428/36.3 |
| 6,131,659 | A * | 10/2000 | Johnson | 166/250.05 |
| 6,631,327 | B2 * | 10/2003 | Hsu et al. | 702/6 |
| 2003/0185100 | A1 * | 10/2003 | D'Angelo et al. | 367/82 |

* cited by examiner

*Primary Examiner*—David Bagnell
*Assistant Examiner*—Giovanna M Collins
(74) *Attorney, Agent, or Firm*—Al C. Metrailer

(57) ABSTRACT

Thin flexible piezoelectric transducers are bonded to or imbedded into oilfield tubular members or structural members. The transducers may be used to telemeter data as acoustic waves through the members. By proper spacing of transducers and phasing of driving signals, the transmitted signals can be directionally enhanced or encoded to improve transmission efficiency. The transducers may be used for health monitoring of the tubular or structural members to detect cracks, delaminations, or other defects. The flexible transducers are very thin so that overall dimensions of tubular or structural members are essentially unchanged by incorporation of the transducers.

25 Claims, 4 Drawing Sheets

FLEXIBLE PIEZOELECTRIC FOR DOWNHOLE SENSING, ACTUATION AND HEALTH MONITORING

CROSS-REFERENCE TO RELATED APPLICATIONS

This application is a divisional application of and claims priority under 35 U.S.C. § 120 to U.S. patent application Ser. No. 10/409,515, filed on Apr. 8, 2003, now U.S. Pat. No. 7,234,519 entitled "Flexible Piezoelectric for Downhole Sensing, Actuation and Health Monitoring", by Michael L. Fripp, et al., which is hereby incorporated by reference for all purposes.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates to piezoelectric devices used in boreholes and oilfield structural members and more particularly to the combination of encapsulated flexible piezoelectric devices with tubular elements in a borehole and with structural members and use thereof for sensing, actuation, and health monitoring.

BACKGROUND OF THE INVENTION

Piezoelectric devices are known to be useful as solid state actuators or electromechanical transducers which can produce mechanical motion or force in response to a driving electrical signal. Stacks of piezoelectric disks have been used, for example, to generate vibrations, i.e. acoustic waves, in pipes as a means of telemetering information. Such transducers are used in drilling operations to send information from downhole transducer generates acoustic waves in a drill pipe which travel through the drill pipe and are received at another borehole location, for example at the surface or an intermediate repeater location. A receiver may include a transducer such as an accelerometer or another piezoelectric device mechanically coupled to the pipe. The received acoustic signals are converted back to electrical signals by the receiving transducer and decoded to recover the information produced by the downhole instruments.

Such piezoceramic materials have not typically been used for other downhole purposes due to their size, shape and brittle characteristics which make them incompatible with downhole structures. Most downhole structures are tubular. There are few flat surfaces for attaching piezoelectric materials. The shoulders required for mechanically coupling the conventional piezoceramic stacks extend from the outer surfaces of the tubular member, e.g. drill pipe, and occupy precious space or require use of larger bits or casing which increases drilling costs.

It would be desirable to provide other transducer structures and applications useful in downhole assemblies and other oilfield structures.

SUMMARY OF THE INVENTION

A system and method for converting electrical energy into acoustic energy, and vice versa, in hydrocarbon production system structural components. Thin and/or flexible piezoelectric transducers have at least one major planar surface bonded to a surface of a structural member. Flexible electrodes on the major planar surfaces of the transducer are used to input electrical energy to induce acoustic waves in the structural member or receive electrical energy produced by acoustic waves in the structural member.

In one telemetry embodiment, thin flexible transducers are bonded to the surface of a borehole tubular element, such as a drill string. Data collected by down hole instruments is encoded into electrical signals which are input to the electrical connection of the transducer. The transducer produces corresponding acoustic waves in the borehole tubular element. Another transducer of the same type may be bonded to the tubular element at another borehole location to receive the acoustic waves and produce corresponding electrical signals for a telemetry receiver.

In another embodiment, thin piezoelectric transducers may be bonded to surfaces of structural members, or laminated into the structure of composite structural members, for health monitoring. Acoustic waves in the structure generated by mechanical defects are received and used to identify the presence of the defects.

In another embodiment, thin flexible piezoelectric transducers are bonded to flow lines for monitoring materials flowing in the lines. Acoustic waves produced in the flow lines by particulate matter can be received and used to identify the particulate matter. Alternatively, the transducers can induce vibrations in the tubular member and analyze the response to determine characteristics of fluids flowing in the flow line.

DETAILED DESCRIPTION OF THE INVENTION

For the purposes of this disclosure, an electromechanical transducer or actuator is any device which can be driven by an electrical input and provides a mechanical output in the form of a force or motion. Many electromechanical transducers also respond to a mechanical input, generally a force, by generating an electrical output. For purposes of the present disclosure, each transducer is considered to have an electrical connection and a mechanical connection. Each connection may be considered to be an input or an output or both, depending on whether the transducer is being used at the time to convert electrical energy into force or motion or to convert force or motion into electrical energy.

A piezoelectric device is an electromechanical transducer which is driven by an electric field, normally by applying a voltage across an electrical connection comprising a pair of electrodes, and changes shape in response to the applied field. The change of shape appears at the mechanical connection of the device. Various crystalline materials, e.g. quartz, ceramic materials, PZT (lead-zirconate-titanate), ferroelectric, relaxor ferroelectric, electrostrictor, PMN, etc. provide piezoelectric responses. These materials usually respond to mechanical force or motion applied to their mechanical connection by generating an electric field which produces a voltage on its electrical connection, e.g. electrodes. As a result, a piezoelectric transducer can be used as an actuator and as a sensor.

Figure 1:
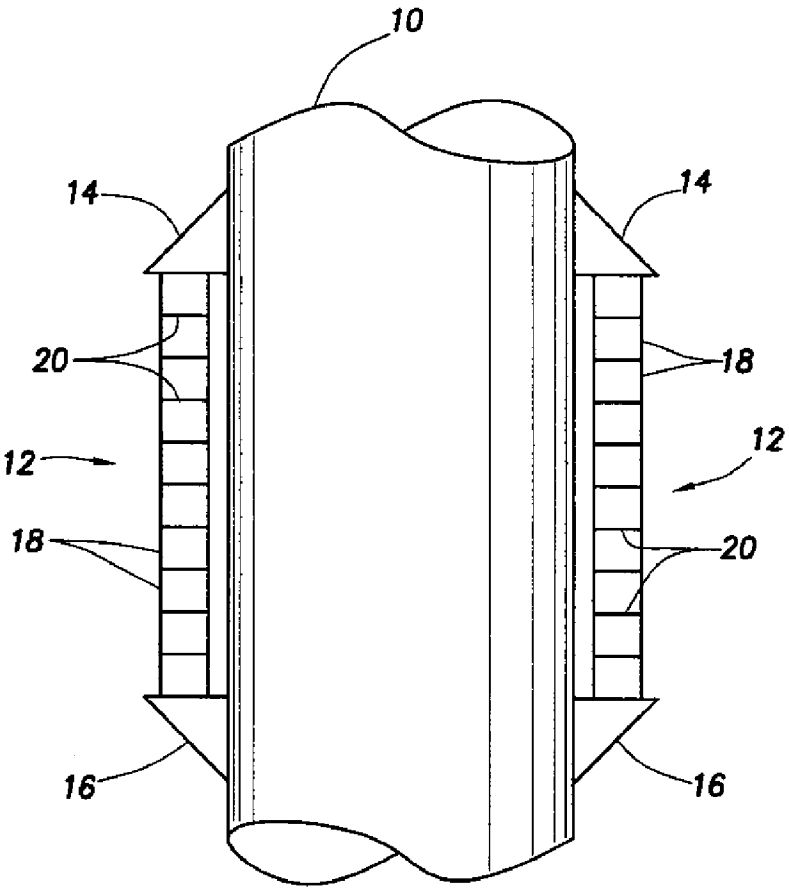
FIG.1 (PRIOR ART)
FIG. 1 is an illustration of a prior art borehole telemetry transducer assembly using stacked piezoelectric transducers.

FIG. 1 is an illustration of a portion of a typical prior art downhole telemetry system. A length of pipe 10 may be part of a drill string in a borehole. In a drilling environment, the pipe 10 serves several purposes. It may transmit turning forces to a drill bit on the bottom of the drill string and normally acts as a conduit for flowing drilling fluid down the well to the bit. It may also provide an acoustic signal transmission medium for sending information from sensors or detectors in the borehole to equipment at the surface location of the well.

Two rod shaped electromechanical transducers 12 are mechanically coupled to the pipe 10 by upper and lower shoulders 14 and 16 which are attached to the pipe 10. The upper and lower ends of the transducers 12 form their mechanical connections which are coupled to the shoulders 14, 16. Mechanical forces generated by the transducers 12 are coupled to the pipe 10 through the shoulders 14, 16. When the transducers 12 are driven with an oscillating electrical signal, they induce a corresponding axial compression signal in the pipe 10. It is desirable to have two transducers 12 spaced on opposite sides of pipe 10, as illustrated, and driven with the same electrical signal to avoid applying bending forces to the pipe 10.

The transducers 12 are typically made from a plurality of circular or square cross section piezoceramic disks 18 stacked to form the linear or rod shaped transducers as illustrated. Between each pair of disks is an electrically conductive layer or electrode 20 which allows application of electrical fields to the disks. Alternate electrodes are electrically coupled in parallel to form the electrical connection of the transducers 12. Polarities of alternate disks are reversed so that upon application of a voltage between successive electrodes, each disk changes shape and the entire stack changes shape by the sum of the change in each disk. The transducers 12 can also be used to detect or receive acoustic waves in the pipe 10 which will generate voltages between the electrodes 20. This construction of a piezoelectric transducer is conventional.

The stacked transducers 12 generally have a length between shoulders 14 and 16 of about twelve inches and have a width of not less than about one-tenth of the length. Thus, the width or diameter of each transducer is generally not less than about 1.25 inch. With transducers positioned on opposite sides of the pipe 10 as illustrated, this transducer assembly adds about three inches to the overall diameter of the pipe 10 assembly.

Figure 2:
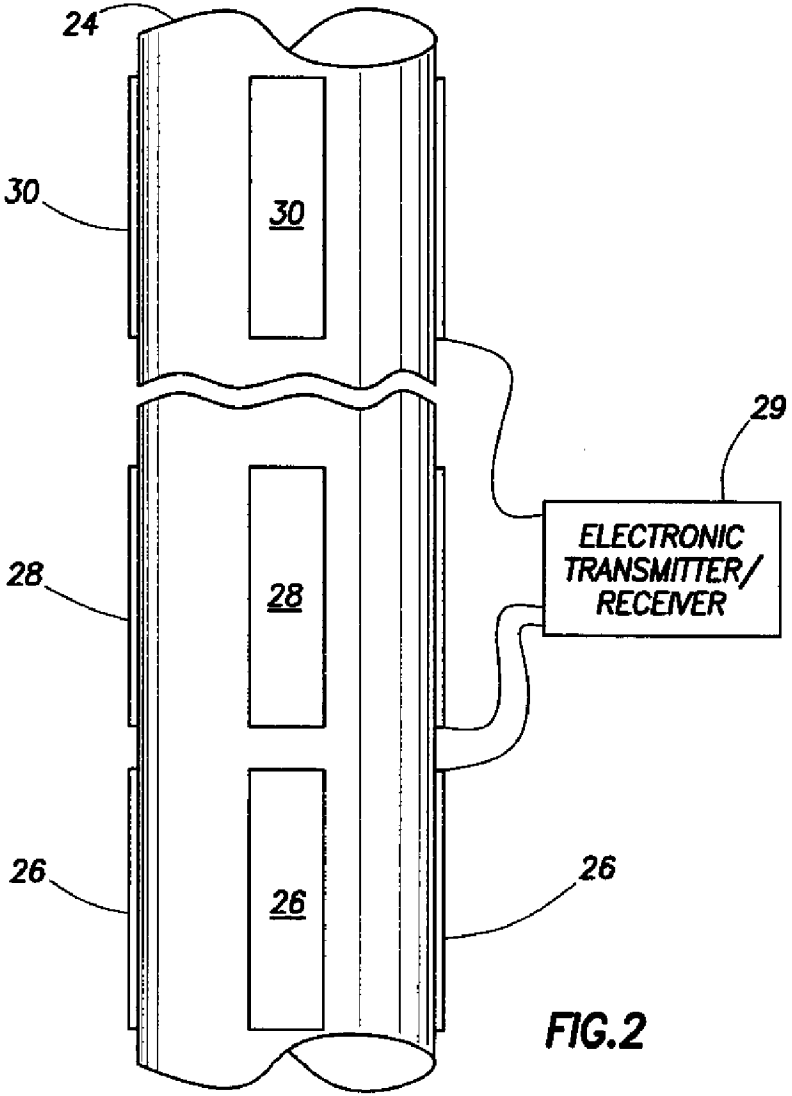
FIG. 2 is an illustration of a borehole telemetry transducer according to one embodiment of the present invention.

FIG. 2 is an embodiment of the present invention which can provide the downhole telemetry transmission function of the prior art system of FIG. 1 with a smaller overall diameter. A section of a borehole tubular member 24 may be a portion of a drill pipe or production tubing in a borehole. For purposes of the present invention, a borehole tubular element need not have a cylindrical shape, but may have flat surfaces and could have a square cross section, e.g. a Kelly joint, so long as it has a closed cross section through which fluids may be flowed. Mechanically bonded to the outer surface of the member 10 are a plurality of thin flexible piezoelectric transducers 26, 28 and 30. It is desirable for transducer 26 to include at least two devices bonded on opposite sides of pipe 24 at the same axial location. In the illustrated embodiment, four transducers 26 are bonded to the pipe 24 at the same axial location and radially displaced from each other by ninety degrees. Each of the transducers 28 and 30 are likewise illustrated as including four separate devices positioned like the devices 26. The pipe 24 is shown as broken to indicate that more of the transducers are bonded to the pipe 24 over a length of about twenty-five feet which, for the particular devices 26, 28, 30 described below, will provide an acoustic energy level about the same as a typical prior art device as illustrated in FIG. 1. The devices 26, 28, 30 may be bonded to the surface of pipe 24 with an adhesive, e.g. an epoxy adhesive. In this arrangement, the entire surface which is bonded to the pipe surface forms the mechanical connection of the transducer. For further strength they may be wrapped with a protective layer of a composite layer, e.g. fiberglass, a metal, e.g. steel, a polymer, e.g. glass impregnated PTFE, etc. It may be desirable to surround the devices 26, 28 and 30 with a protective housing, such as a metal sleeve. Space between the sleeve and the pipe 24 may be filled with a fluid such as oil for pressure balancing. Such a protective housing would not only provide protection from permanent damage to the devices 26, 28 and 30 but may isolate them from lesser contacts with other parts of the well, e.g. the borehole wall, which may generate acoustic noise and interfere with the intended functions of the devices.

In the embodiment of FIG. 2, at least one large planar surface of the devices 26, 28 and 30 is bonded by an adhesive to a surface of the pipe 24. For purposes of the present invention, the term "bonded" means any mechanical attachment of the mechanical connection of a transducer which causes the transducer to experience essentially the same strains as the member to which it is bonded. Thus in some cases, only the ends and or edges of the devices 26, 28 and 30 may be attached by adhesive to a surface in order for the strains to be the same. The devices 26, 28 and 30 may be attached by adhesive to an intermediate part, e.g. a piece of shim, which is attached to the surface by bolting, welding, an adhesive, etc. In similar fashion, a wrap of a protective composite may bond the devices to the surface sufficiently to ensure that the strains are shared. Thus, the prior art devices 12 of FIG. 1 may be considered bonded to the pipe 10 by being clamped between shoulders 14 and 16, whether or not an adhesive is used to attach the mechanical connections, i.e. the ends, of the devices 12 to the shoulders 14 and 16.

Figure 3:
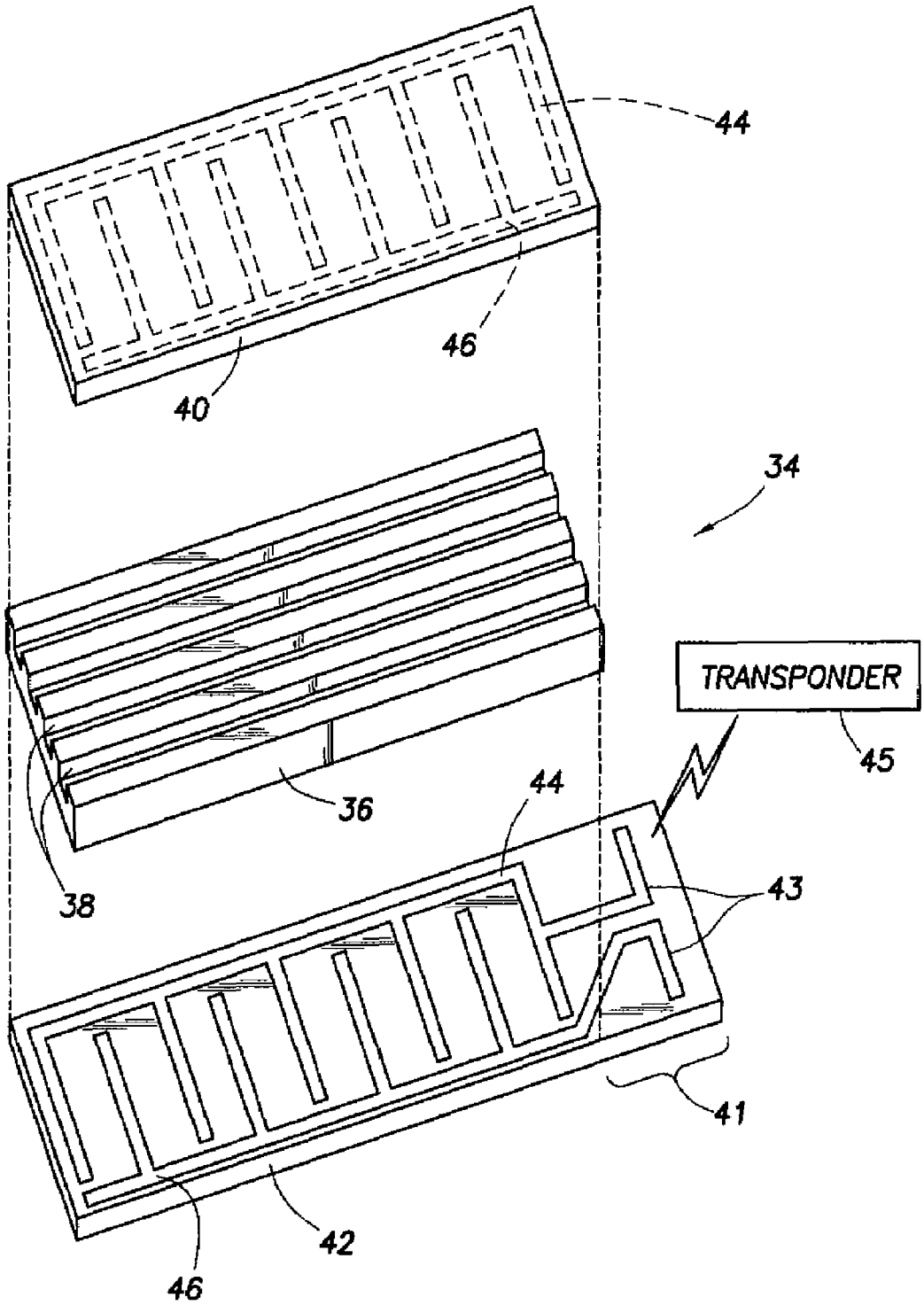
FIG. 3 is an exploded view of a piezoelectric transducer useful in the FIG. 2 embodiment.

FIG. 3 illustrates one embodiment of the structure of a transducer 34 which may be used for each of the devices 26, 28 and 30 of FIG. 2. The center of device 34 may be formed of a thin rectangular slab 36 of piezoceramic which has been machined to be made flexible. A series of grooves 38 have been machined, e.g. by laser etching, along the long dimension of the slab 36. The grooves make the slab flexible, especially across its short dimension. The grooved piezoceramic slab 36 may be made according to the teachings of U.S. Pat. No. 6,337,465 issued to Masters et al. on Jan. 8, 2002 which is incorporated herein for all purposes.

Two flexible insulating sheets 40 and 42 are bonded to the upper grooved and lower ungrooved surfaces of the slab 3, by for example an epoxy adhesive. In this embodiment, the flexible sheets 40 and 42 are made of a copper coated polyimide film, e.g. a film sold under the trademark Kapton. The copper coating has been etched to form a set of interdigitated electrodes 44 and 46 on sheets 40 and 42. The electrodes 44, 46 are shown in phantom on sheet 40 because in the exploded view, they lie on the lower side of sheet 40. The electrodes 44 and 46 form the electrical connection for the completed transducer 34. When the sheets 40 and 42 are attached to the slab 38, the electrodes 44 and 46 are positioned between the sheets 40, 42 and the slab 36.

Figure 4:
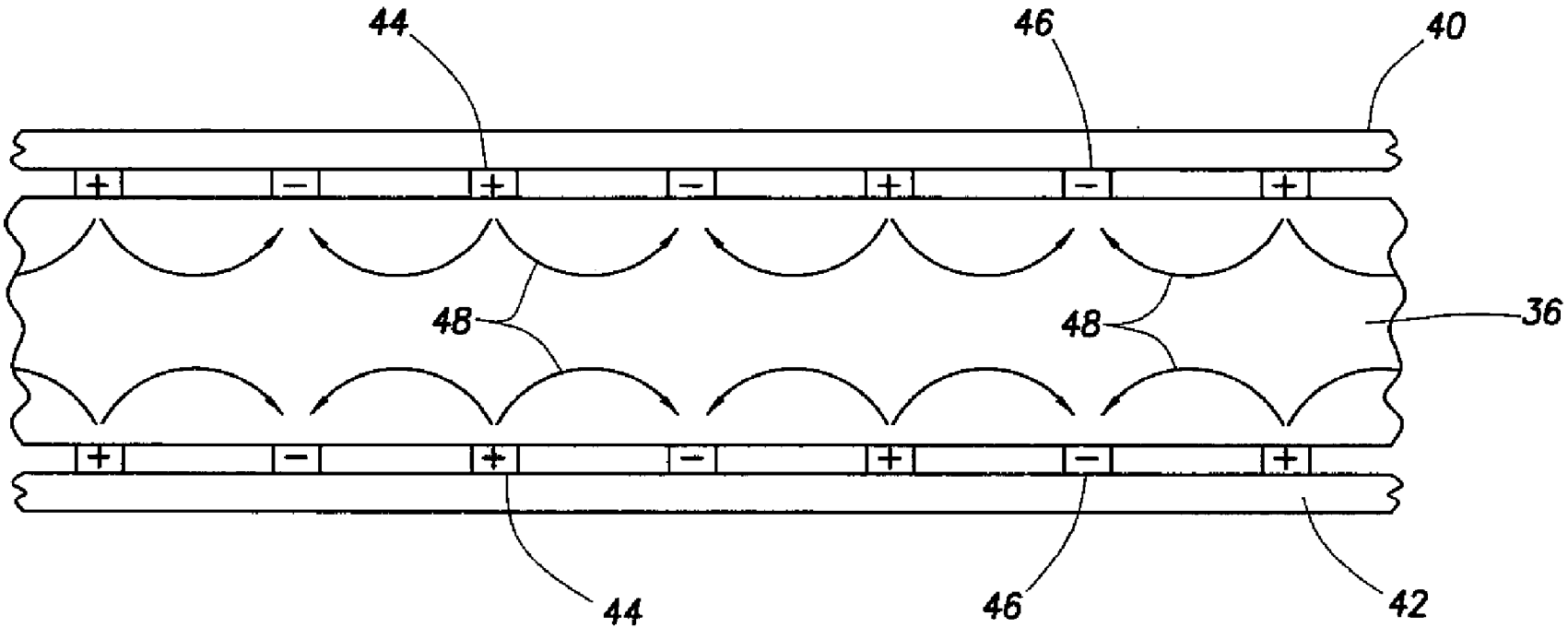
FIG. 4 is a partial cross sectional view of the transducer of FIGS. 2 and 3 illustrating an arrangement of electrodes and resulting electric fields.

FIG. 4 provides a cross sectional view of a portion of the device 34 of FIG. 3. In FIG. 4, the center piezoceramic material 36 is shown sandwiched between the insulating sheets 40 and 42, with the electrodes 44 and 46 in contact with the slab 36. The electrodes 44 and 46 on the sheets 40 and 42 are aligned so that electrodes 44 lie opposite each other and electrodes 46 lie opposite each other as shown. A typical electrical field pattern is illustrated for the case where electrodes 44 are positive and the electrodes 46 are negative as indicated by the plus and minus signs. The arrows 48 indicate the fields generated within the piezoceramic material 36 by this condition. The key point is that the field is basically in alignment with the long dimension of the rectangular piezoceramic slab 36. This is desirable for providing improved mechanical output in response to applied electrical potential. This preferred mechanical response is a change in the long dimension of the slab 36, that is it is a directional response. When the device 34 mechanical connection is bonded to the surface of a structural member, the dimensional change is transferred or applied to the structural member. In an alternative arrangement, each sheet 40 and 42 may be covered by a complete copper film forming two electrodes which could be oppositely charged. The resulting field would be from top to bottom of the slab 36, which would provide a smaller mechanical response than is provided by the illustrated arrangement. One benefit of this alternative arrangement is a lower driving voltage requirement.

Currently available devices 34 have a length of about 2.5 inches and a width of about one inch. The thickness of slab 36 may be from about 0.001 inch to 0.500 inch. For use in embodiments described herein, the thickness may be from about 0.005 to about 0.025 inch. The length is desirably at least twenty times the thickness to minimize end effects. Greater thickness provides more mechanical power, but reduces the flexibility of the devices. Devices as shown in FIG. 3 having a slab 36 thickness of about 0.020 inch can be bent around and bonded to a pipe having an outer diameter of about 3.5 inches or larger. For a thickness of about 0.010 inch, the devices can be bent around a pipe having an outer diameter of about one inch or larger. For best acoustic impedance match, it would be desirable for the thickness of slab 36 to equal the wall thickness of the pipe to which it is bonded. Generally, this is not practical because this would result in a transducer which would be too stiff to be bent around the pipe, and, as explained below, too thick for generation of desired electrical fields at practical voltages. Thus, the specific dimensions of the flexible transducers used in the FIG. 2 embodiment will be selected according to the available material lengths and widths. Thinner slabs 36 or multiple devices 34 may be stacked to create the transducer behavior of a thicker slab without compromising the flexibility of the device and without requiring undesirable driving voltages.

The thickness of the slab 36 also affects the electrical connection of the device 34. As the device is made thicker, the electrode voltage needed to provide a desirable field increases. Use of thinner devices allows use of lower driving voltages which is desirable. When these electrical interface considerations are considered along with the flexibility factors, a slab thickness of about 0.010 inch provides a good compromise. As noted above, multiple devices may be stacked to increase mechanical power, while maintaining mechanical flexibility and low driving voltage.

Other flexible piezoelectric transducers may be used in place of the particular embodiment shown in FIG. 3. For example, U.S. Pat. Nos. 5,869,189 and 6,048,622 issued to Hagood, IV et al. on Feb. 9, 1999 and Apr. 11, 2000, which are incorporated herein for all purposes, disclose a suitable alternative. The Hagood transducer uses a plurality of flexible piezoceramic fibers aligned in a flat ribbon of a relatively soft polymer. Flexible electrodes like those shown in FIG. 3 and FIG. 4 are positioned on opposite sides of the composite transducer for activating the device. Flexible piezopolymers may also be used in relatively low temperature applications. This temperature limitation normally prevents using piezopolymers in downhole applications. Current piezopolymers also lack sufficient stiffness or induced stress capability to be used for structural actuation.

In addition to the continuous fibers disclosed in the Hagood patent, a piezoelectric composite can be created in other forms. The fibers can be woven fibers or chopped fibers. Additionally, the composite can be formed with particulate piezoelectric material. The particulate piezoelectric material may either be floating or it can be arranged into chains, for example with electrophoresis.

The flexible transducers of the present invention share important advantages over the prior art structure shown in FIG. 1. They are manufactured as a flat device, which is much more practical than attempting to manufacture a rigid curved piezoceramic transducer to fit a particular tubular element, i.e. an element with a given diameter. Since they are flexible, they will conform to any curved surface within the limits of their flexibility, i.e. they fit a range of tubular goods with a range of diameters. They may be bonded directly to the surface of metal tubular goods or may be laminated into the structure of composite tubular goods useful in down hole systems or other oilfield structural components. The flexibility of the devices is in part achieved by using thin slabs or fibers of piezoceramic material. The devices are extremely thin when compared to the prior art devices. As a result, the flexible devices do not effectively reduce clearances or require larger casing, etc. Normally they may extend from the tubular element by less than conventional joints or collars for which clearances are already provided. The fact that the flexible piezoelectric devices are made primarily of a parallel set of linear fibers or rods makes them inherently directional in their acoustic outputs. As a result of these advantages, there are numerous applications for flexible piezoelectric devices in down hole and other oilfield environments.

The piezoelectric devices used in the embodiments described herein are distinguished from the prior art devices in both being thin and flexible. They are also distinguished by the fact that the electrodes, e.g. 44 and 46 of FIG. 3, forming the electrical connection lie on surfaces which are parallel to the long dimension of the devices, which is also the direction of primary mechanical output of the devices. This direction is also parallel to the surface of the borehole structure, e.g. drill pipe, to which the piezoelectric device is bonded. In contrast, the prior art stacked devices of FIG. 1, use electrodes which lie in planes perpendicular to the primary mechanical output direction and extend all the way through or across the stack. As discussed above, to have sufficient flexibility to be bonded to or in tubular goods, the devices are preferably thin as indicated by dimensions listed above. The devices are as a minimum sufficiently flexible to bend, without substantially degrading performance, with the structural members to which they are bonded, even if they are bonded to a flat surface. The structures to which the devices are bonded in the described embodiments all experience large forces and will bend to some extent. To be considered thin for purposes of the present invention, the devices of the present invention must also be thin enough to allow application of sufficient field strength, e.g. the fields 48 of FIG. 4, at voltages which are reasonably achievable in an oilfield down hole environment. In the prior art stacked devices, the thickness of the individual disks may be adjusted for the available voltage, since the electrodes extend all the way through or across the stacked device. The devices of the present invention must be thin enough for sufficient fields to be generated by the electrodes on the main planar surfaces of the devices as illustrated in the drawings.

One use of the system shown in FIG. 2 is a downhole data telemetry system. This is the same application as described for the prior art device of FIG. 1. Each of the plurality of transducers 26, 28, 30 may be electrically connected together and driven by the output of an electronic transmitter and/or receiver package 29 on a drill string, e.g. part of a logging while drilling system. Data collected by the package, e.g. temperature and pressure, may be digitally encoded and then transmitted up the drill string as acoustic waves. For example, in a dual tone system, a digital one may be transmitted as a first frequency acoustic signal and a zero as a second frequency acoustic signal. The telemetry driver supplies the desired frequency electrical signals to the transducers 26, 28 and 30, and they generate acoustic waves in the drill pipe 24 at the same frequencies. The signals travel up the drill pipe and may be detected by a similar set of transducers attached to a length of drill pipe at the surface of the earth or at an intermediate repeater location. The original digital data may be recovered from the detected signals.

As noted above, it may take a plurality of flexible transducers 26, 28, 30 bonded to about twenty-five feet of pipe 24 to generate acoustic power equivalent to the power produced by the prior art stacks shown in FIG. 1. The system of this embodiment allows an alternative driving system to be used, which effectively provides the same power level with only about a ten-foot series of the transducers 26, 28 and 30. Instead of wiring all of the electrical connections of transducers 26, 28 and 30 together so that they are driven in phase, they may be driven separately as a phased array. For example, the acoustic velocity in the pipe 24 can be measured. The distance between transducers 26 and 28 is known. At a given signal frequency, it is therefore possible to determine the phase shift or time delay between acoustic signals generated at transducers 26 and 28. The electrical input signal to transducer 28 can be delayed relative to the signal applied to device 26 by the appropriate phase shift or time delay so that the acoustic signal generated by transducer 28 is in phase with the acoustic signal from transducer 26 when it reaches the location of transducer 28. Likewise the electrical signal driving device 30 can be delayed by an amount appropriate to provide acoustic waveform reinforcement to the wave traveling up the pipe 24 from transducers 26 and 28. For equally spaced transducers 26, 28, 30 the shift or delay between each pair would be the same. Note that the reinforcement is directional. That is, the signal may be reinforced in the desirable upwardly traveling direction while it is reduced in the downward traveling direction. The signal reinforcement allows generation of a larger acoustic signal in the desired direction with less of the transducers.

Further telemetry enhancement may be achieved by using the same phased array approach for a receiving array of transducers. A set of transducers identical to the transducers 26, 28, 30 of FIG. 2, may be bonded to the drill string up hole from the transmitter. The electrical connections from each set may be connected through corresponding time delays or phase shifts before they are combined in a receiver. This phasing again makes the array directional and effectively improves gain of the receiver.

The phased array arrangement may also be used to advantage in a repeater which receives signals from a lower down hole location and retransmits it to an up hole location such as another repeater or the final receiver at the well head. Two arrays of transducers as shown in FIG. 2 may be part of a repeater. One can be used with a receiver phased to receive acoustic waves preferentially from down hole. Another can be used with a transmitter phased to transmit signals preferentially up hole. Alternatively, a single array may be used for both the receiver and the transmitter. That is, the receiver with inputs phased for receiving from down hole can be coupled to the same set of transducers as a transmitter with outputs phased to cause the transducer array to transmit up hole.

Figure 5:
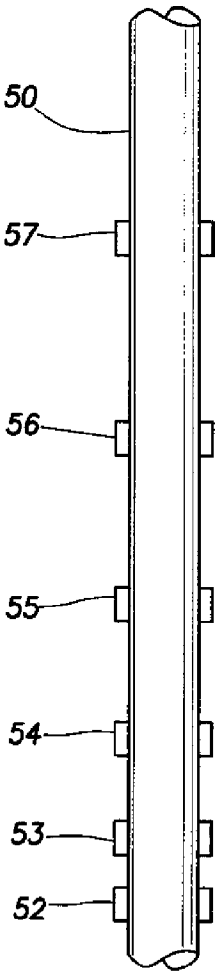
FIG. 5 is an illustration of placement of a plurality of piezoelectric transducers on a signal transmission medium to provide an encoded signal.

FIG. 5 illustrates another embodiment which provides an improved signal transmission capability. A drill pipe 50 is shown with a series of transducer pairs 52, 53, 54, 55, 56 and 57. The spacing between pairs progressively increases from the closest spacing between devices 52 and 53 to the greatest spacing between devices 56 and 57. If these devices 52-57 are driven with an impulse or short tone signal, a coded series of acoustic waves will be generated in the pipe 50. This type of signal is similar to a chirp signal. If a set of transducers having the same spacings is attached to another portion of the pipe 50 as a receiver with its electrical connections wired in series, the detected signals will reinforce and generate an enhanced output when the specific waveform produced by the transducers 52-57 is detected. The spacings between adjacent transducers 52-57 need not be in the simple progression shown in FIG. 5, but may be in a random order of different spacings. Two sets of transducers with different spacing sets may be used to represent a digital one and a digital zero for telemetry purposes. Some of the transducers may be shared between the two sets. The uniformly spaced transducers 26, 28, 30 of FIG. 2 may be used to produce such coded signals if each transducer is individually driven so that random sets of the transducers can be selected for transmission. In any case, the use of flexible piezoelectric transducers according to these embodiments provides telemetry encoding and signal directional enhancement which was much less practical with prior art systems.

In the FIG. 2 embodiment, the long dimension of transducers 26, 28, 30 is aligned with the axis of the tubular member 24. Since the transducers are directional, this is an efficient way to produce axial compression waves in the pipe 24. It may be desired to transmit information with other types of mechanical waves, e.g. torsional mode, hoop mode, etc.

Figure 6:
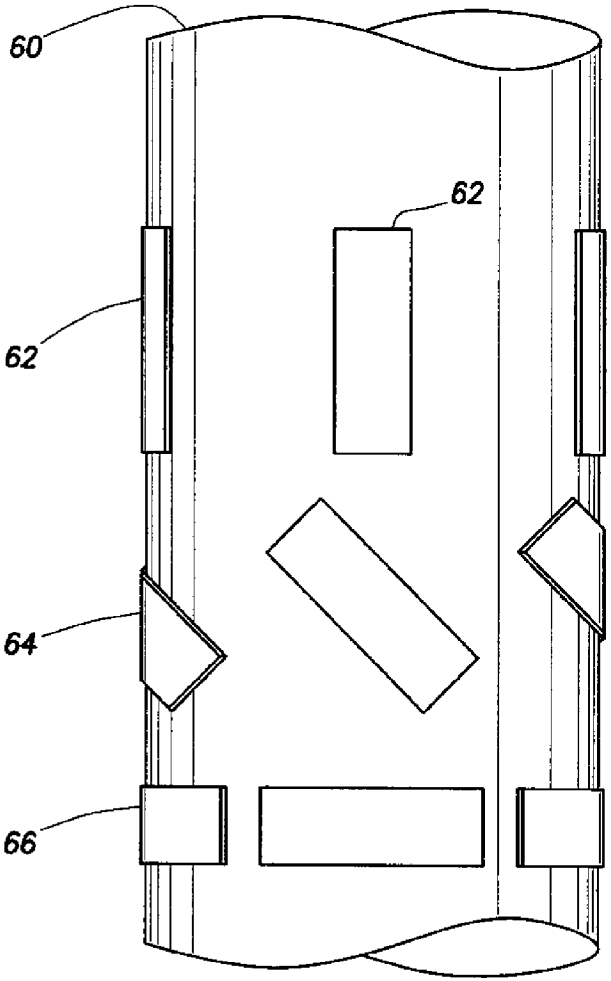
FIG. 6 is an illustration of placement of a plurality of piezoelectric transducers on a signal transmission medium to provide or sense compressional, torsional and hoop waves.

FIG. 6 illustrates a multimode set of transducers bonded to a tubular element 60 to produce three different wave modes. Four devices 62 are bonded to the element 60 with long dimensions aligned with the central axis of element 60. These are positioned like the transducers 26, 28 and 30 of FIG. 2, and will primarily produce or detect axial compression waves in the element 60 if they are driven with the same signal. If desired, the devices 62 may be driven separately and out of phase to generate flexural waves in the pipe 60. Four other devices 64, which may be identical to devices 62, are bonded to the element 60 at an angle of about thirty to sixty degrees relative to the central axis of pipe 60. In the FIG. 6 embodiment, they are shown positioned at about forty-five degrees. Since the devices are directional and generate forces in alignment with the long dimension of the devices 64, these devices will produce, or detect, torsional waves in the element 60. Another set of transducers 66 is shown bonded to the element 60 with their axes positioned perpendicular to the central axis of the element 60. When devices 66 are driven, they will change the radius of the pipe and create hoop waves. Likewise, devices 66 will preferentially detect hoop waves. While the structure of the transducers 26, 28, 30 makes them more flexible across their width than their length, they are also flexible along their long dimension and can be bonded to a tubular element at an angle as illustrated for devices 64 and 66.

The transducer array of FIG. 6 allows transmission or detection of essentially all acoustic wave modes which may be intentionally carried on an element in a borehole. It also allows detection of essentially any form of acoustic noise which may be generated by drilling or production operations in a well. An array of the sets of transducers as shown in FIG. 6 may be positioned along a length of a tubular element in the manner illustrated in FIG. 2 or in FIG. 5. This arrangement allows selective transmission of telemetry by any mode, e.g. compression, torsional, hoop or flexural mode. The particular mode may be chosen based on noise levels occurring in a well at the time. An array allows use of directional or coded signals as discussed above in any wave mode.

The multimode transducer set of FIG. 6 also allows detection and cancellation of various noises which may interfere with acoustic telemetry. Acoustic noise may be generated in borehole elements by numerous sources. The drill bit is a large source of acoustic noise. But noise may also be generated by contact of a drill string with a borehole wall at any point along its length. Noise from any source may travel up the drill string by more than one mode, e.g. both compression and torsion waves. However, the different wave modes travel at different velocities. By detecting all wave modes with a set of devices 62, 64, 66, and processing the signals to determine arrival time differences, the distance to the noise source can be determined. This could indicate excessive wear occurring on a drill pipe and identify the depth at which it is occurring.

It is common for a drill bit to generate large torsional noises in a drill string which may interfere with acoustic telemetry even in other modes. The multimode transducer set of FIG. 6 may allow cancellation of torsional noises while simultaneously transmitting telemetry using compression waves. Thus torsional noise from a drill bit may be detected by one or more torsional devices 64. A noise cancellation processor may then transmit a torsional wave out of phase with the noise to at least partially cancel the upward traveling torsional noise. This would provide a better condition for compression wave telemetry using the axially aligned devices 62.

The same piezoelectric transducer can be used as an actuator to create the telemetry waves as well as a sensor to sense the telemetry waves. By measuring both the voltage and the charge, a single piezoelectric device can be used simultaneously as a actuator and a sensor.

The individual transducers, e.g. 26, 28, 30 of FIG. 2, need not have the simple rectangular shape as shown in the figures. It may be desirable to taper the shape of the transducers. For example they may be more narrow at their ends than in the center, e.g. a football, circular, or diamond shape. Such shaping may allow generation of specially shaped acoustic waves or better impedance matching of the transducers 26, 28, 30 to the tubular members to which they are bonded. The shape of the electromechanical coupling of the transducer can be tapered by changing the spacing of the electrodes, by changing the density of piezoelectric fibers, or by changing the pattern etched by the laser.

The embodiments described herein may also be used for structural health monitoring. With reference to FIG. 2, transducers 26 and 30 may be used to determine if any structural defects, e.g. cracks, have occurred between the two transducers. When the system is installed, signals may be transmitted from transducer 26 and received by transducer 30. A record of signal strength, phase shift, spectral content etc. can be made. From time to time, the test transmission can be repeated and compared to the original records. Changes in the signal transmission can indicate cracks or other defects in the structure between the transducers 26 and 30. This arrangement can be used on any tubular or other structural members in a borehole, on subsea risers, flow lines, platform support members, etc. Sets of the multimode transducers of FIG. 6 may allow more detailed collection of health monitoring information for a tubular element.

Many of these structural members, flow lines, etc. are being made of composite structures instead of metal. The composite structures may include fibers of glass, carbon, graphite, ceramic, etc. in a matrix of epoxy or other resin or polymer. As noted above, the transducers may be imbedded in the composites at the time of manufacture. Devices imbedded in composites may be used without conductors, i.e. wires, extending from imbedded transducers to the outer surface of the structural member. The flexible insulating films 40, 42 of FIG. 3 can be extended, e.g. at 41, to include antenna structures 43 and integrated surface-mount electronics and batteries for coupling signals to and from the transducers. Transponders, 45, can be placed close to the transducers for coupling signals through the composite materials to and from the transducers. This arrangement may be particularly useful for health monitoring tests which may be performed on a monthly or yearly schedule.

Structural health monitoring may also be done with a single piezoelectric transducer, especially one laminated into a composite structure. The capacitance of the device can be measured by the driving circuitry, e.g. the electronic transmitter/receiver 29 of FIG. 1 acting as a capacitance detector. Any delamination of the composite structure at the transducer will change the measured capacitance of the device. A device used for telemetry purposes can also be used for health monitoring. A single transducer can be used to "listen" for signs of structural failure. As cracks form, they make distinctive sounds which are often relatively easily detected by a transducer imbedded in the structure. A structure with cracks or delaminations may also make distinctive noises as it flexes during normal operations. For example, a composite subsea riser moves in response to wave action and currents and these movements create noises at structural defects. Forces may intentionally be applied to such structures to cause motion and stress which would create detectable noises at structural defects. Intentionally applied forces may provide a more quantitative measure of structural health, since the applied force may be known or measured. The transducers of the present invention are particularly suited to these applications because of relatively large profile in length and width and the distributed arrangement along structural members. These transducers are more likely to detect such defects than a point source type of transducer.

The disclosed embodiments are also useful for vibration sensing. They are sensitive enough to detect some vibrations caused by solids, e.g. sand, in produced fluids. Vibrations caused by the flowing fluids themselves may also be detected. Since many fluids flow in relatively small diameter flow lines, the flexible piezoelectric transducers are particularly suited to these applications. They may be bonded directly to the inner or outer surfaces of the flow lines, or may be laminated into the wall of a composite flow line, to detect such vibrations. Flow lines are one of the popular applications of composite materials in which the flexible transducers may be imbedded. Since the piezoelectric devices are self-powered, electrical connections may be made directly from the transducer electrodes to the input of a suitable amplifier and recording system, etc. to detect the vibrations. The systems may include spectral analyzers for identifying frequencies and/or patterns or signatures which are known to be produced by particular failure mechanisms.

The disclosed embodiments may be used for detecting the flow of fluids other than solids as discussed above. It is desirable in producing oil and gas wells to determine the composition of fluids flowing in a flow line. The fluids typically are a mixture of oil and/or gas and/or water. If turbulent flow is created at the location of a transducer as described above, the noise generated by the flow can be analyzed to identify the types of fluids in the flow line. Turbulence can be created by providing a constriction or upset in the flow line. Thus could assist with particle or fluid flow detection.

The hoop mode transducers 66 of FIG. 6 may also be used for evaluation of fluids in a flow line. A hoop mode wave at one or more frequencies may be generated in a flow line by devices 66. The response of the flow line will depend on the density, viscosity and other characteristics of fluid in the line. The resonant frequency may be measured and used to estimate fluid parameters.

In addition to simply receiving signals for telemetry, health monitoring, etc. the piezoelectric devices used in the various embodiments may also be used for power generation. As noted above, the structural members used in hydrocarbon producing facilities typically experience large forces, strains, etc. This represents a large amount of available energy. By attaching appropriate rectifying and conditioning circuitry to the electrical connections of downhole piezoelectric devices, electrical power may be generated. This is especially useful for recharging down hole batteries used to power various sensors and telemetry equipment.

In many of the above-described applications of the flexible piezoelectric transducers, it may be desirable to provide reactance balancing by combining an inductive type of transducer with a piezoelectric device as described herein. This approach is described in more detail in a co-pending U. S. Pat. No. 6,998,999, issued Feb. 14, 2006, entitled Hybrid Piezoelectric and Magnetostrictive Actuator, by inventors Michael L. Fripp and Roger L. Schultz, which application is hereby incorporated by reference for all purposes.

It is apparent that various changes can be made in the apparatus and methods disclosed herein, without departing from the scope of the invention as defined by the appended claims.

What we claim is:

1. A method for converting between electrical energy and acoustic energy in a borehole tubular member, comprising:

bonding at least one major planar surface of a flexible piezoelectric device having a length, width and thickness, the length and width defining the at least one major planar surface as manufactured, to a curved surface of a borehole tubular member, the flexible piezoelectric device having a mechanical response aligned with one of the length and width, and producing and/or detecting compression forces in the wellbore tubular member aligned with the surface of the wellbore tubular member with the flexible piezoelectric device.

2. The method of claim 1, further comprising coupling an electrical transmitter to an electrical connection of the flexible piezoelectric device.

3. The method of claim 1, further comprising coupling an electrical receiver to an electrical connection of the flexible piezoelectric device.

4. The method of claim 3, further comprising using energy received from the flexible piezoelectric device as an electrical power source.

5. The method of claim 3, further comprising charging a battery with energy received from the flexible piezoelectric device.

6. A method for telemetering data in a borehole, comprising:

bonding a major planar surface of a first flexible piezoelectric device having a length, width and thickness, the length and width defining the major planar surface as manufactured, to a curved surface of a tubular member adapted for use in a borehole, the first flexible piezoelectric device having a mechanical response aligned with one of the length and width, and coupling electrical signals to an electrical connection of the first flexible piezoelectric device.

7. The method of claim 6, further comprising:

bonding a plurality of the first flexible piezoelectric devices to the tubular member at locations axially displaced along the tubular member, and coupling electrical signals to electrical connections of each of the plurality of the first flexible piezoelectric devices.

8. The method of claim 7, further comprising phase shifting the electrical signals coupled to each of the plurality of the first flexible piezoelectric devices, whereby a directionally enhanced acoustic signal is induced in the tubular member.

9. The method of claim 6, further comprising:

bonding a major planar surface of a second flexible piezoelectric device having a length, width and thickness, the length and width defining the major planar surface as manufactured to a curved surface of the tubular member, the second flexible piezoelectric device having a mechanical response aligned with one of the length and width, and receiving electrical signals from an electrical connection of the second flexible piezoelectric device.

10. The method of claim 9, further comprising:

bonding a plurality of the second flexible piezoelectric devices to the tubular member at locations axially displaced along the tubular member, and receiving electrical signals from electrical connections of each of the plurality of the first flexible piezoelectric devices.

11. The method of claim 10, further comprising phase shifting and combining the electrical signals received by each of the plurality of the second flexible piezoelectric devices, whereby a directionally enhanced acoustic signal is received from the tubular member.

12. A method for monitoring mechanical health of a structural member in an oil production system, comprising:

bonding a major planar surface of a flexible piezoelectric transducer having a length, width and thickness, the length and width defining the major planar surface, to a structural member adapted for use in an oil production system, the flexible piezoelectric device having a mechanical response aligned with one of the length and width, and producing and/or detecting compression forces in the structural member aligned with said one of the length and width with the flexible piezoelectric transducer.

13. The method of claim 12, further comprising receiving electrical signals generated at the electrical connection of the flexible piezoelectric transducer by acoustic energy in the structural member.

14. The method of claim 13, further comprising analyzing the received electrical signals for indications of defects in the structural member.

15. The method of claim 13, further comprising applying an external force to the structural member.

16. A method for detecting the flow of material through a tubular element in a hydrocarbon production system, comprising:

bonding a major planar surface of a flexible piezoelectric transducer having a length, width and thickness, the length and width defining the major planar surface as manufactured, to a curved surface of a tubular element adapted for flowing materials in an oil production system, the flexible piezoelectric device having a mechanical response aligned with one of the length and width, and producing and/or detecting compression forces in the tubular element aligned with said one of the length and width with the flexible piezoelcetric transducer.

17. The method of claim 16, further comprising receiving electrical signals generated at the electrical connection of the flexible piezoelectric transducer by acoustic energy in the tubular member.

18. The method of claim 17, further comprising analyzing the received electrical signals to identify materials flowing in the tubular member.

19. The method of claim 16, further comprising driving said transducer with an electrical signal to induce vibrations in the tubular element.

20. The method of claim 19, further comprising analyzing the response of the tubular element to the vibrations to measure at least one parameter of fluid within the tubular element.

21. The method of claim 20, wherein said parameter is one of viscosity, density and ratio of water to oil.

22. A method for transmitting and receiving acoustic waves in a tubular element in a hydrocarbon production system, comprising:

bonding a major planar surface of a first flexible piezoelectric transducer having a length, width and thickness, the length and width defining the major planar surface as manufactured, to a curved surface of a tubular element adapted for use in a hydrocarbon production system, said first flexible piezoelectric transducer having a mechanical response aligned with one of the length and width, the mechanical response of the first flexible piezoelectric transducer positioned at a first angle relative to the axis of the tubular element, and bonding a major planar surface of a second flexible piezoelectric transducer having a length, width and thickness, the length and width defining the major planar surface as manufactured, to a curved surface of the tubular element, said second flexible piezoelectric transducer having a mechanical response aligned with one of the length and width, the mechanical response of the second flexible piezoelectric transducer positioned at a second angle relative to the axis of the tubular element, the second angle being different from the first angle.

23. The method of claim 22, wherein the first flexible piezoelectric transducer mechanical response is substantially in alignment with the axis of the tubular element and the second flexible piezoelectric transducer mechanical response is substantially out of alignment with the axis of the tubular element.

24. The method of claim 23 further comprising:

receiving acoustic waves with the first and second flexible piezoelectric transducers, and analyzing the received acoustic waves to estimate the distance to the source of the acoustic waves.

25. The method of claim 23, further comprising:

telemetering data through the tubular element with the first flexible piezoeleetrie transducer, and transmitting an acoustic wave in the tubular element with the second flexible piezoelectric transducer, which acoustic wave at least partially cancels an acoustic wave generated by a noise source.

* * * * *